US008196268B1

(12) United States Patent
Placeres

(10) Patent No.: US 8,196,268 B1
(45) Date of Patent: Jun. 12, 2012

(54) FASTENING SYSTEM

(76) Inventor: Anthony Placeres, Los Angeles, CA (US)

( * ) Notice: Subject to any disclaimer, the term of this patent is extended or adjusted under 35 U.S.C. 154(b) by 161 days.

(21) Appl. No.: 12/752,795

(22) Filed: Apr. 1, 2010

(51) Int. Cl.
*A44B 1/04* (2006.01)
*A44B 11/25* (2006.01)
*A44B 17/00* (2006.01)

(52) U.S. Cl. ..... 24/303; 24/522; 24/529; 63/900

(58) Field of Classification Search ..... 24/303, 24/522, 526, 527, 529, 114.4, 114.05, 114.12; 63/900, 29.2; 403/DIG. 1
See application file for complete search history.

(56) References Cited

U.S. PATENT DOCUMENTS 2,615,227 A * 10/1952 Hornik ..... 24/303
2,648,884 A * 8/1953 Loofboro ..... 24/303
4,969,241 A 11/1990 Griffin
D319,201 S 8/1991 Aoki
5,611,120 A 3/1997 Riceman et al.
5,630,258 A * 5/1997 Schneider ..... 24/303
6,163,938 A 12/2000 Weber-Unger
6,292,985 B1 * 9/2001 Grunberger ..... 24/303
6,622,349 B2 * 9/2003 Wong ..... 24/303
6,647,597 B2 11/2003 Reiter
6,804,865 B2 * 10/2004 Grunberger et al. ..... 24/303
7,065,841 B2 6/2006 Sjoquist
2005/0102802 A1 * 5/2005 Sitbon et al. ..... 24/303
2006/0236509 A1 10/2006 Ausman

* cited by examiner

*Primary Examiner* — Robert J Sandy
*Assistant Examiner* — Abigail E Morrell

(57) ABSTRACT

A fastening system for fastening materials together featuring a first magnet for attaching to the first material; a second magnet for attaching to the second material; a slanted aperture disposed on a bottom surface of the first magnet; and a slanted peg protruding from a bottom surface of the second magnet, the slanted aperture is adapted to snugly receive the slanted peg; wherein the first material and second material are fastened together by aligning and sliding the slanted peg into the slanted aperture, wherein magnetic forces keep the first magnet attracted to the second magnet.

4 Claims, 3 Drawing Sheets

Alternative

FASTENING SYSTEM

FIELD OF THE INVENTION

The present invention is directed to a means of fastening materials together, more particularly to a system involving a magnetic peg-and-hole assembly.

BACKGROUND OF THE INVENTION

The fastening of materials is usually accomplished with devices such as buttons, clips, zippers, hook-and-loop fasteners, buckles, and the like. These devices often require strength and dexterity to manipulate. The present invention features a fastening system for fastening materials together. The fastening system of the present invention is easy to use and allows a user to quickly fasten materials together with very little strength or dexterity.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
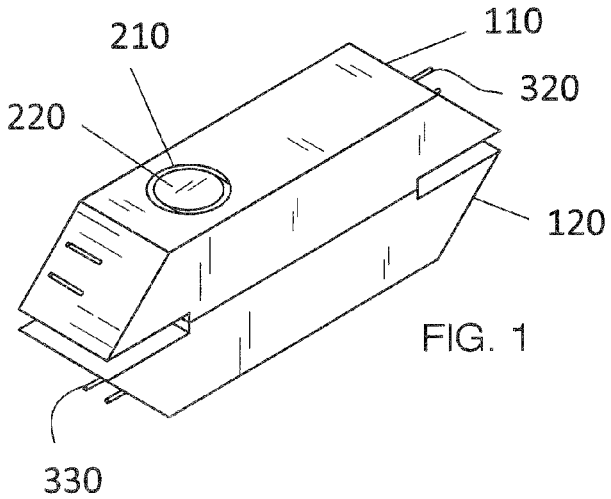
FIG. 1 is a perspective view of the fastening system of the present invention.

Referring now to FIGS. 1-5, the present invention features a fastening system 100 for fastening materials (e.g., cloth, leather, plastic, the like, or a combination thereof) together. The fastening system 100 of the present invention is easy to use and allows a user to quickly fasten materials together with very little strength or dexterity. The fastening system 100 may be used with garments such as robes, belts, straps for shoes and sandals, or with any situation where two pieces of material must be fastened together.

The fastening system 100 comprises a first magnet 110 and a second magnet 120. The first magnet 110 has a top surface 114 and a bottom surface 115. The second magnet 120 has a top surface 124 and a bottom surface 125. The magnets 110, 120 are engageable, for example the bottom surface 115 of the first magnet 110 can engage the bottom surface 125 of the second magnet 120.

Figure 2:
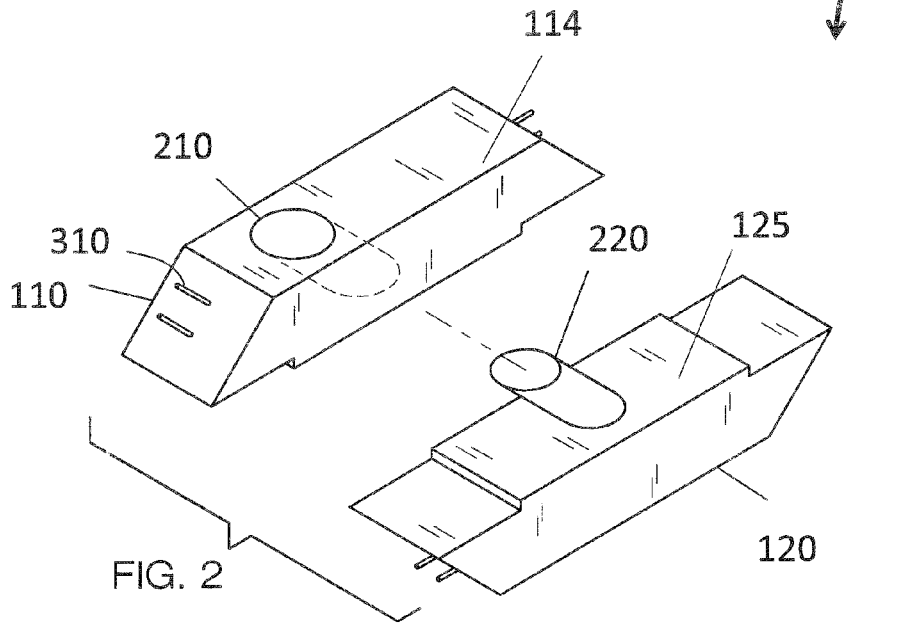
FIG. 2 is an exploded view of the fastening system of FIG. 1.
Figure 3:
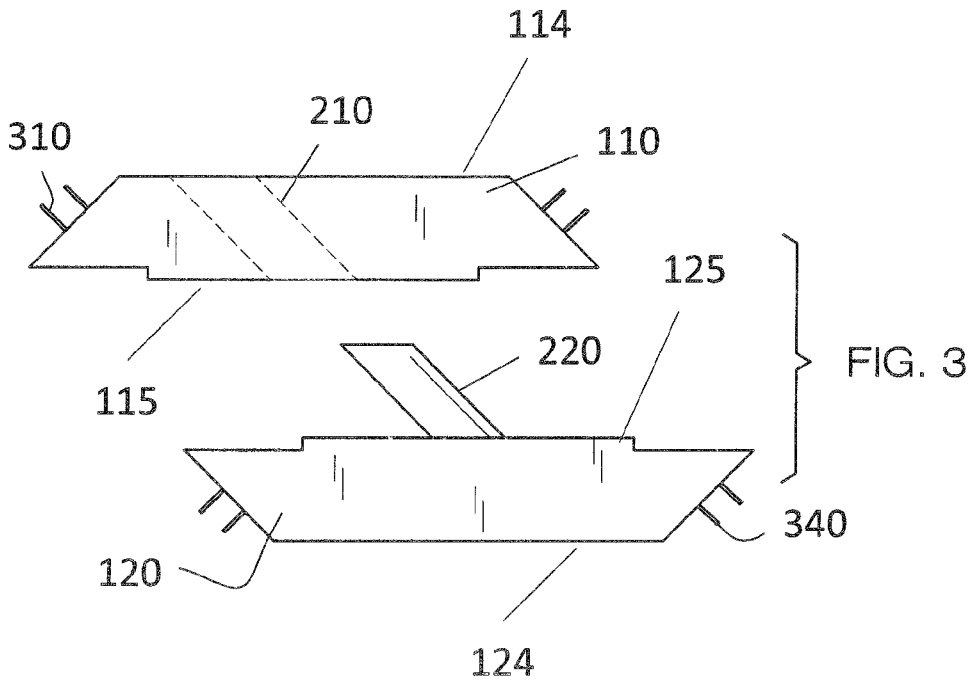
FIG. 3 is a side view of the fastening system of FIG. 1.

Disposed on the bottom surface 115 of the first magnet 110 is a first locking component 210 and disposed on (or protruding from) the bottom surface 125 of the second magnet 120 is a second locking component 220. As shown in FIG. 2 and FIG. 3, in some embodiments, the first locking component 210 is an aperture and the second locking component 220 is a peg. The aperture is adapted to snugly receive the peg. In some embodiments, the aperture is slanted and the peg is slanted. The peg may be constructed from a magnetic material, for example the same material used for the second magnet 120, or a nonmagnetic material embedded in the body of the second magnet 120.

The peg-in-the-hole system (e.g., first locking component 210 and second locking component 220) allows for a secure connection between the two magnets 110, 120. To fasten two pieces of material together (e.g., a garment), the second locking component 220 (e.g. peg) and the first locking component 210 (e.g., aperture, hole) are aligned so that the second locking component 220 (e.g. peg) slides into the first locking component 210 (e.g., aperture, hole) and the attraction between the two magnets 110, 120 holds them together. Without wishing to limit the present invention to any theory or mechanism, it is believed that the slanted peg and slanted aperture are advantageous because they provide additional strength to the connection between the two magnets. For example, the slanted peg and slanted hole (when engaged) can resist separation when forces exist (in the opposite direction of the slant of the peg 220) that would tend to separate the two magnets 110, 120. The magnetic attraction helps hold the peg firmly in the aperture.

Figure 5:
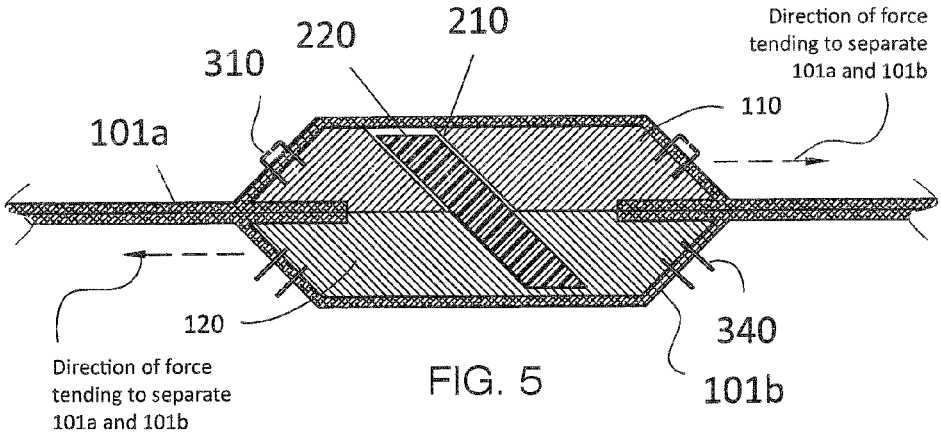
FIG. 5 is a cross sectional view of the fastening system of FIG. 1.

The fastening system 100 may be constructed in a variety of sizes and shapes, as well as designs. In some embodiments, the first magnet 110 and/or second magnet 120 are generally trapezoidal in shape. The fastening system 100 may be constructed so as to be generally inconspicuous on a garment. For example, as shown in FIG. 5, the two magnets 110, 120 are integrated into two pieces of material 101 (a first material 101*a* and a second material 101*b*).

The system 100 may further comprise a plurality of embedded clips for helping to secure the magnets 110, 120 to clothing or material (e.g. the first material 101*a* and/or second material 101*b*). For example, in some embodiments, a first embedded clip 310 (or a plurality of first embedded clips 310) is disposed on the first magnet 110 on a first side and a second embedded clip 320 (or a plurality of second embedded clips 320) is disposed on the first magnet 110 on a second side. In some embodiments, a third embedded clip 330 (or a plurality of third embedded clips 330) is disposed on the second magnet 120 on a first side and a fourth embedded clip 340 (or a plurality of fourth embedded clips 340) is disposed on the second magnet 120 on a second side.

Figure 3A:
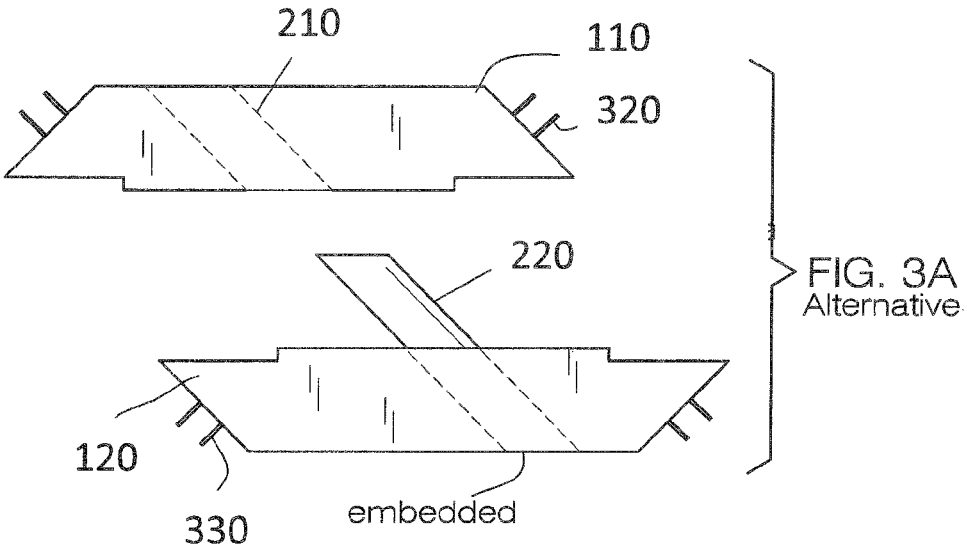
Figure 4:
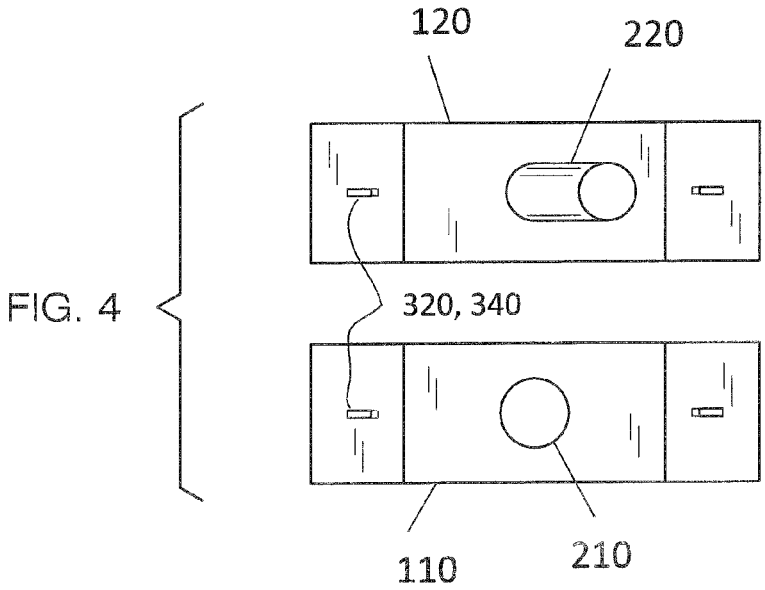
FIG. 4 is a top view of the fastening system of FIG. 1.

As shown in FIG. 3A, in some embodiments, the second locking component 220 may be embedded in the second magnet 120, for example if the second locking component 220 is not magnetic.

The following the disclosures of the following U.S. Patents are incorporated in their entirety by reference herein: U.S. Pat. No. 4,969,241; U.S. Pat. Application No. 2006/0236509; U.S. Pat. No. 6,163,938; U.S. Pat. No. 5,611,120; U.S. Pat. No. 7,065,841; U.S. Pat. No. 6,647,597.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A fastening system for fastening a first material and a second material together, said fastening system comprising:

(a) a first magnet for attaching to or integrating into the first material;

(b) a second magnet for attaching to or integrating into the second material;

(c) a first locking component disposed on a bottom surface of the first magnet, the first locking component is a slanted aperture;

(d) a second locking component protruding from a bottom surface of the second magnet, the second locking component is a slanted peg, the slanted aperture is adapted to snugly receive the slanted peg; and (e) a first embedded clip disposed on the first magnet on a first side, a second embedded clip disposed on the first magnet on a second side, a third embedded clip disposed on the second magnet on a first side, and a fourth embedded clip disposed on the second magnet on a second side, the first and second embedded clips function to help secure the first magnet to the first material and the third and fourth embedded clips function to help secure the second magnet to the second material;

wherein the first material and second material are fastened together by aligning and sliding the slanted peg into the slanted aperture, wherein magnetic forces keep the first magnet attracted to the second magnet.

2. The fastening system of claim 1, wherein the first magnet or the second magnet is generally trapezoidal in shape.

3. The fastening system of claim 1, wherein the second locking component is embedded in the second magnet.

4. The fastening system of claim 1, wherein the slanted peg is constructed from a magnetic material or an embedded non-magnetic material.

* * * * *